US009027567B2

(12) United States Patent
Gee et al.

(10) Patent No.: US 9,027,567 B2
(45) Date of Patent: May 12, 2015

(54) ORAL POUCH PRODUCT WITH MULTI-LAYERED POUCH WRAPPER

(75) Inventors: Diane L. Gee, Richmond, VA (US); Gregory J. Griscik, Midlothian, VA (US); Mark S. North, Richmond, VA (US); Robley Eugene Pitts, Jr., Midlothian, VA (US); Yahaira R. Ramos, Chester, VA (US)

(73) Assignee: Philip Morris USA Inc., Richmond, VA (US)

( * ) Notice: Subject to any disclaimer, the term of this patent is extended or adjusted under 35 U.S.C. 154(b) by 672 days.

(21) Appl. No.: 12/805,868

(22) Filed: Aug. 20, 2010

(65) Prior Publication Data

US 2011/0180087 A1 Jul. 28, 2011

Related U.S. Application Data

(63) Continuation of application No. 12/648,924, filed on Dec. 29, 2009, now abandoned.

(60) Provisional application No. 61/141,550, filed on Dec. 30, 2008.

(51) Int. Cl.

| | |
|---|---|
| ***A24B 15/00*** | (2006.01) |
| ***A24B 15/28*** | (2006.01) |
| ***A24B 13/00*** | (2006.01) |
| ***A24B 15/30*** | (2006.01) |

(52) U.S. Cl.

CPC ..... *A24B 15/283* (2013.01); *A24B 13/00* (2013.01); *A24B 15/30* (2013.01)

(58) Field of Classification Search

None

See application file for complete search history.

(56) References Cited

U.S. PATENT DOCUMENTS

| | | | |
|---|---|---|---|
| 307,537 | A | 11/1884 | Foulks |
| 1,234,279 | A | 7/1917 | Buchanan |
| 1,376,586 | A | 5/1921 | Schwartz |
| 1,992,152 | A | 2/1935 | Yeates |
| 2,313,696 | A | 3/1941 | Yates |
| 2,306,400 | A | 12/1942 | Menzel |
| 2,318,101 | A | 5/1943 | Rose |
| 2,330,361 | A | 9/1943 | Howard |
| 2,528,778 | A | 11/1950 | Piazze |
| 3,174,889 | A | 3/1965 | Anderson et al. |
| 3,188,265 | A | 6/1965 | Charbonneau et al. |
| 3,369,551 | A | 2/1968 | Carroll |
| 3,415,286 | A | 12/1968 | Arnold et al. |

(Continued)

FOREIGN PATENT DOCUMENTS

| | | |
|---|---|---|
| EP | 0245575 | 11/1987 |
| EP | 0145499 | 4/1989 |

(Continued)

OTHER PUBLICATIONS

Satel, Sally M.D., "A Smokeless Alternative to Quitting," Apr. 6, 2004, The New York Times, Accessed Oct. 25, 2010; http://query.nytimes.com/gst/fullpage.html?res=9402EFD91E39F935A35757C0A9629C8B63.

*Primary Examiner* — Richard Crispino
*Assistant Examiner* — Phu Nguyen
(74) *Attorney, Agent, or Firm* — Buchanan Ingersoll & Rooney PC

(57) ABSTRACT

An oral pouch product includes a dual layer pouch wrapper and an inner botanical filling material contained within the pouch wrapper. The pouch wrapper includes an inner web, an outer web and a coating, such as a water soluble flavorant containing coating therebetween.

14 Claims, 2 Drawing Sheets

(56) References Cited

U.S. PATENT DOCUMENTS

| | | | | |
|---|---|---|---|---|
| 3,600,807 | A | | 8/1971 | Sipos |
| 3,607,299 | A | | 9/1971 | Bolt |
| 3,692,536 | A | | 9/1972 | Fant |
| 3,757,798 | A | | 9/1973 | Lambert |
| 3,846,569 | A | | 11/1974 | Kaplan |
| 3,932,192 | A | | 1/1976 | Nakashio et al. |
| 4,565,702 | A | | 1/1986 | Morley et al. |
| 4,607,479 | A | | 8/1986 | Linden |
| 4,703,765 | A | * | 11/1987 | Paules et al. ..... 131/112 |
| 4,880,697 | A | | 11/1989 | Caldwell et al. |
| 4,892,483 | A | | 1/1990 | Douglas, Jr. |
| 4,907,605 | A | | 3/1990 | Ray et al. |
| 4,917,161 | A | | 4/1990 | Townend |
| 5,127,208 | A | | 7/1992 | Custer et al. |
| 5,167,244 | A | | 12/1992 | Kjerstad |
| 5,174,088 | A | | 12/1992 | Focke et al. |
| 5,346,734 | A | | 9/1994 | Wydick, Jr. |
| 5,601,716 | A | | 2/1997 | Heinrich et al. |
| 5,806,408 | A | | 9/1998 | DeBacker et al. |
| 5,921,955 | A | | 7/1999 | Mazer et al. |
| 5,927,052 | A | | 7/1999 | Nippes et al. |
| 5,997,691 | A | | 12/1999 | Gautam et al. |
| 6,021,624 | A | | 2/2000 | Richison et al. |
| 6,135,120 | A | | 10/2000 | Löfman et al. |
| 6,143,316 | A | | 11/2000 | Hayden et al. |
| 6,146,655 | A | | 11/2000 | Ruben |
| 6,162,516 | A | | 12/2000 | Derr |
| D489,606 | S | | 5/2004 | Lofman |
| 7,032,601 | B2 | | 4/2006 | Atchley et al. |
| 7,090,858 | B2 | | 8/2006 | Jayaraman |
| D568,576 | S | | 5/2008 | Neidle et al. |
| D585,626 | S | | 2/2009 | Chappell, Sr. et al. |
| 7,950,399 | B2 | | 5/2011 | Winterson et al. |
| 7,980,251 | B2 | | 7/2011 | Winterson et al. |
| 8,067,046 | B2 | | 11/2011 | Schleef et al. |
| 2002/0012689 | A1 | | 1/2002 | Stillman |
| 2002/0170567 | A1 | | 11/2002 | Rizzotto et al. |
| 2003/0070687 | A1 | | 4/2003 | Atchley et al. |
| 2003/0109492 | A1 | | 6/2003 | Loftsson |
| 2003/0224090 | A1 | | 12/2003 | Pearce et al. |
| 2004/0018293 | A1 | | 1/2004 | Popplewell et al. |
| 2004/0037879 | A1 | | 2/2004 | Adusumilli et al. |
| 2004/0118421 | A1 | | 6/2004 | Hodin et al. |
| 2004/0123873 | A1 | | 7/2004 | Calandro et al. |
| 2004/0202698 | A1 | | 10/2004 | Ramji et al. |
| 2004/0247649 | A1 | | 12/2004 | Pearce et al. |
| 2004/0247744 | A1 | | 12/2004 | Pearce et al. |
| 2004/0247746 | A1 | | 12/2004 | Pearce et al. |
| 2005/0003048 | A1 | | 1/2005 | Pearce et al. |
| 2005/0034738 | A1 | | 2/2005 | Whalen |
| 2005/0061339 | A1 | | 3/2005 | Hansson et al. |
| 2005/0100640 | A1 | | 5/2005 | Pearce |
| 2005/0210615 | A1 | | 9/2005 | Shastry et al. |
| 2005/0244521 | A1 | | 11/2005 | Strickland et al. |
| 2005/0287249 | A1 | | 12/2005 | Shukla et al. |
| 2006/0073190 | A1 | | 4/2006 | Carroll et al. |
| 2006/0118589 | A1 | | 6/2006 | Arnarp et al. |
| 2006/0144412 | A1 | | 7/2006 | Mishra et al. |
| 2006/0174901 | A1 | | 8/2006 | Karles et al. |
| 2006/0191548 | A1 | | 8/2006 | Strickland et al. |
| 2006/0204598 | A1 | | 9/2006 | Thompson |
| 2006/0228431 | A1 | | 10/2006 | Eben et al. |
| 2007/0062549 | A1 | | 3/2007 | Holton, Jr. et al. |
| 2007/0107747 | A1 | | 5/2007 | Hill et al. |
| 2007/0122526 | A1 | | 5/2007 | Sweeney et al. |
| 2007/0186941 | A1 | | 8/2007 | Holton, Jr. et al. |
| 2007/0186942 | A1 | | 8/2007 | Strickland et al. |
| 2007/0186943 | A1 | | 8/2007 | Strickland et al. |
| 2007/0186944 | A1 | | 8/2007 | Strickland et al. |
| 2007/0190157 | A1 | | 8/2007 | Sanghvi et al. |
| 2007/0207239 | A1 | | 9/2007 | Neidle et al. |
| 2007/0261707 | A1 | * | 11/2007 | Winterson et al. ..... 131/352 |
| 2007/0267033 | A1 | | 11/2007 | Mishra et al. |
| 2008/0029110 | A1 | | 2/2008 | Dube et al. |
| 2008/0029116 | A1 | | 2/2008 | Robinson et al. |
| 2008/0029117 | A1 | | 2/2008 | Mua et al. |
| 2008/0081071 | A1 | | 4/2008 | Sanghvi et al. |
| 2008/0166395 | A1 | | 7/2008 | Roush |
| 2008/0173317 | A1 | | 7/2008 | Robinson et al. |
| 2008/0196730 | A1 | | 8/2008 | Engstrom et al. |
| 2008/0202536 | A1 | | 8/2008 | Torrence et al. |
| 2008/0302682 | A1 | | 12/2008 | Engstrom et al. |
| 2008/0308115 | A1 | | 12/2008 | Zimmerman et al. |
| 2009/0004329 | A1 | | 1/2009 | Gedevanishvili et al. |
| 2009/0022856 | A1 | | 1/2009 | Cheng et al. |
| 2009/0022917 | A1 | | 1/2009 | Gedevanishvili et al. |
| 2009/0025738 | A1 | | 1/2009 | Mua et al. |
| 2009/0025739 | A1 | | 1/2009 | Brinkley et al. |
| 2009/0025740 | A1 | | 1/2009 | Chappell, Sr. et al. |
| 2009/0025741 | A1 | | 1/2009 | Crawford et al. |
| 2009/0035414 | A1 | | 2/2009 | Cheng et al. |
| 2009/0126746 | A1 | | 5/2009 | Strickland et al. |
| 2010/0218779 | A1 | | 9/2010 | Zhuang et al. |
| 2010/0300464 | A1 | | 12/2010 | Gee et al. |
| 2010/0300465 | A1 | | 12/2010 | Zimmermann |
| 2011/0083680 | A1 | | 4/2011 | Mishra et al. |

FOREIGN PATENT DOCUMENTS

| | | | |
|---|---|---|---|
| EP | 0483500 | A1 | 5/1992 |
| EP | 0 422 898 | | 9/1994 |
| EP | 0 599 425 | | 10/1997 |
| GB | 1350740 | | 4/1974 |
| JP | 03-240665 | | 10/1991 |
| WO | WO 94/25356 | | 11/1994 |
| WO | WO 97/45336 | | 12/1997 |
| WO | WO 99/40799 | | 8/1999 |
| WO | WO 00/57713 | | 10/2000 |
| WO | WO 01/70591 | A1 | 9/2001 |
| WO | WO 02/080707 | A1 | 10/2002 |
| WO | WO 03/028492 | A1 | 4/2003 |
| WO | WO 03/030881 | | 4/2003 |
| WO | WO 03/053175 | A2 | 7/2003 |
| WO | WO 2004/009445 | | 1/2004 |
| WO | WO 2004/052335 | | 6/2004 |
| WO | WO 2004/056219 | | 7/2004 |
| WO | WO 2004/058217 | | 7/2004 |
| WO | WO 2004/064811 | A1 | 8/2004 |
| WO | WO 2004/066986 | | 8/2004 |
| WO | WO 2004/095959 | A1 | 11/2004 |
| WO | WO 2005/027815 | | 3/2005 |
| WO | WO 2005/046363 | A | 5/2005 |
| WO | WO 2005/077232 | | 8/2005 |
| WO | WO 2006/004480 | | 1/2006 |
| WO | WO 2006/039487 | A | 4/2006 |
| WO | WO 2006/065192 | | 6/2006 |
| WO | WO 2006/105173 | | 10/2006 |
| WO | WO 2006/120570 | A2 | 11/2006 |
| WO | WO 2006/127772 | A | 11/2006 |
| WO | WO 2007/037962 | A | 4/2007 |
| WO | WO 2007/057789 | A2 | 5/2007 |
| WO | WO 2007/057791 | A2 | 5/2007 |
| WO | WO 2007/104573 | | 9/2007 |
| WO | WO 2007/126361 | A1 | 11/2007 |
| WO | WO 2008/016520 | A2 | 2/2008 |
| WO | WO 2008/042331 | A2 | 4/2008 |
| WO | WO 2008/104891 | A2 | 9/2008 |
| WO | WO 2008/140372 | A1 | 11/2008 |

* cited by examiner

ORAL POUCH PRODUCT WITH MULTI-LAYERED POUCH WRAPPER

CROSS REFERENCE TO RELATED APPLICATION

This application is a continuation application of U.S. application Ser. No. 12/648,924 entitled ORAL POUCH PRODUCT WITH MULTI-LAYERED POUCH WRAPPER, filed on Dec. 29, 2009 now abandoned which claims priority under 35 U.S.C. §119(e) to U.S. provisional Application No. 61/141,550, filed on Dec. 30, 2008, the entire content of which is incorporated herein by reference.

SUMMARY

In one embodiment, an oral pouch product comprises: a pouch wrapper including an inner web and an outer web, a coating along at least one of the inner web and the outer web, and an inner botanical filling material contained within the pouch wrapper. The inner web is surrounded by the outer web, the coating is between the inner web and the outer web and surfaces of the outer web are sealed in a web to web relation along at least one seam.

In another embodiment, a method of making an oral pouch product comprises feeding an inner web and an outer web along a feed path, the inner web and/or the outer web having a coating on a side thereof between the inner and outer webs, folding the inner web and the outer web into a tubular formation while maintaining the coating between the inner web and the outer web, forming a longitudinal seam along overlapping edges of the outer web and a lower transverse seam across the tubular formation, placing a portion of an inner botanical filling material into the tubular formation above the transverse seam, and forming an upper transverse seam across the tubular formation to enclose the filling.

DETAILED DESCRIPTION

Figure 1:
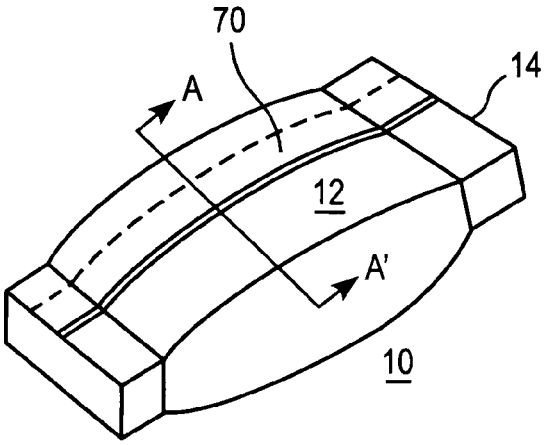
FIG. 1 illustrates an oral pouch product with a multi-layered pouch wrapper including an outer web, an inner web and a coating on the inner web and/or the outer web.
Figure 2:
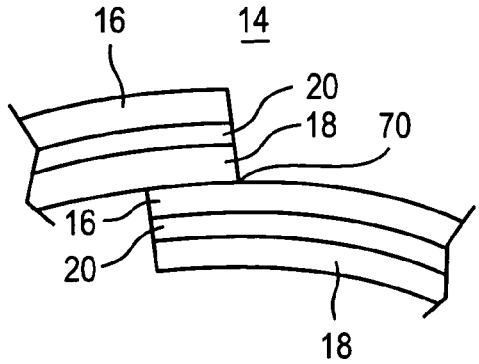
FIG. 2 is an illustration of the longitudinal seam of the oral pouch product of FIG. 1.
Figure 3:
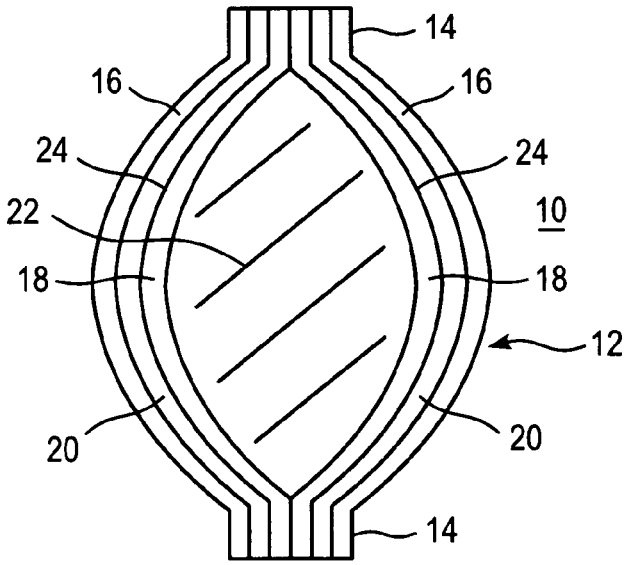
FIG. 3 illustrates a cross-sectional view of the oral pouch product of FIG. 1.

As described herein and illustrated in FIGS. 1, 2 and 3, an oral pouch product 10 comprises a pouch wrapper 12 and an inner botanical filling material 22 (shown in FIG. 3) contained within the pouch wrapper 12. The pouch product 10 is an oral pouch product that is designed to be placed in the mouth, preferably between the cheek and gum, for oral enjoyment. The pouch wrapper 12 is a permeable or semi-permeable wrapper, such that saliva can pass through the pouch wrapper 12 to the interior of the pouch product, and the flavors and juices from the inner botanical filling material contained within the interior of the pouch product can be drawn out of the pouch and into the user's mouth. The pouch wrapper 12 comprises an inner web, an outer web and a coating on the inner web and/or the outer web. The coating lies between the inner web and the outer web when the pouch wrapper 12 is assembled.

As shown in FIGS. 1 and 2, the oral pouch product 10 comprises a longitudinal seam 70. The longitudinal seam 70 can comprise overlapping sections of an inner web 18 and an outer web 16, as shown in FIG. 2. In other embodiments, the longitudinal seam 70 can only comprise the outer web 16 of the oral pouch product 10. Preferably, the oral pouch product 10 also includes at least one transverse seam 14, which can comprise the inner web 18 and the outer web 16 or only the outer web 16 (not shown).

In a preferred embodiment, as shown in FIG. 2, the longitudinal seam 70 is formed such that the inner web 18 contacts the outer web 16. In an embodiment, the inner web and/or the outer web can comprise paper, fabric, and/or other non-dissolvable and/or non-disintegrable materials.

In other embodiments, as shown in FIG. 3, the transverse seams 14 can be formed such that the inner web 18 of one side of the oral pouch product 10 contacts another section of the inner web 18 to form the seam 14. In an embodiment, the transverse seams 14 can also include the outer web 16.

As shown in FIG. 3, the pouch wrapper 12 comprises at least two webs. In the preferred embodiment, the pouch wrapper 12 comprises an outer web 16 and an inner web 18. Preferably, the inner web 18 includes a coating 20. Also preferably, the coating 20 comprises at least one flavorant.

With reference to FIG. 3, a pouch wrapper 12 comprises an inner web 18 comprising a coating 20 applied to an outer side of the inner web 18 to form a coated inner web. In the preferred embodiment, the inner web 18 and coating 20 are arranged such that the coating 20 is between the outer web 16 and the inner web 18 when the pouch wrapper 12 is assembled.

Figure 4:
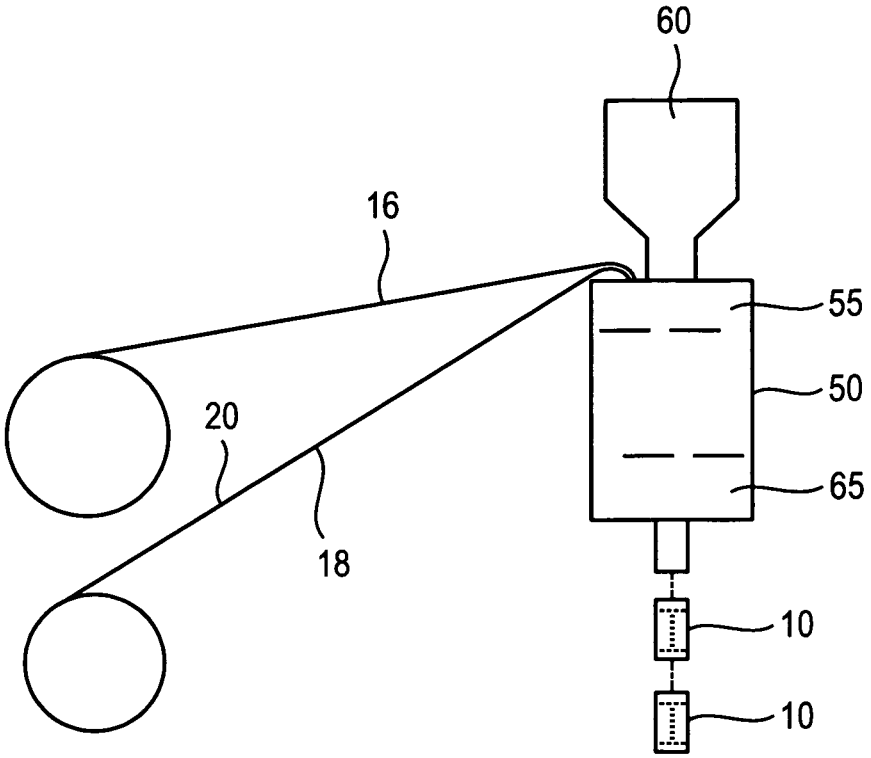
FIG. 4 is an illustration of a machine for forming the oral pouch product of FIG. 1

As shown in FIG. 4, pouch forming operations can be executed by feeding a ribbon of outer web 16 through a poucher machine 50, such as those manufactured by Merz Verpackungsmaschinen GmbH, Lich, Germany. Such systems typically include a folding horn or shoe 55, a cutter 65 and a feeder 60, which cooperate to repetitively fold the ribbon of web into a tube, close-off and seal an end portion of the tube, feed a measured amount of pouch filling material into the closed-off tube to create a filled portion of the tube and seal and sever the filled portion of the tube to repetitively form individual pouches 10.

In a preferred embodiment, a ribbon of an inner web 18 bearing a coating 20 on one side is drawn into contact with a ribbon of outer web 16 as the two ribbons of web material 16, 18 are drawn into the poucher 50. The outer web 16 and the inner web 18 are situated such that the coating 20 lies between the inner web 18 and the outer web 16. This arrangement prevents the coating 20 from contacting the parts of the poucher machine 50 and the filling material of the oral pouch product 10. Consequently, build-up of the coating 20 on machine parts is avoided and feeding operations are rendered smoother because there is less opportunity for the wrapper material 16, 18 or the inner filling material to stick to the coating build-up on the machine parts.

In an embodiment, the coating 20 can be continuously applied to a side 24 of a ribbon of paper comprising inner web 18. The inner web 18 including the coating 20 can then be continuously fed with the outer web 16 to form pouches during a pouch forming and filling operation.

In another embodiment, the outer web can include a coating on a side. The outer web is drawn into contact with an inner web, such that the coating is between the outer web and the inner web:

In a preferred embodiment, the wrapper material including the outer web 16 and the inner web 18 can be, for example, about 31 mm and 26 mm wide, respectively. The outer web 16 and the inner web 18 can be fed along a feedpath and folded into a tubular formation with the coated side of the inner web 18 facing the outer web 16. In so doing, the longitudinal edge portions of the web material are brought into an overlapping relation and sealed to form the longitudinal seam 70 (shown in FIG. 1), which is preferably about 3 mm wide in the exemplary embodiment.

Oral pouch products 10 are continuously formed by introduction of predetermined amounts of the inner botanical filling material 22 into the tubular form above a transverse seam, formation of an upper transverse seam above the filling and cutting the tubular formation at locations along the length of the tubular formation to form individual pouches.

Sealing may be accomplished by any suitable sealing method, such as, for example, adhesive or by mutual sealing. Mutual sealing may be thermal or sonic, depending on the sealing properties of the particular web. Preferably, sealing is accomplished by thermal sealing. Preferably, the inner web is paper with a flavor coating on one side and is sized to avoid becoming part of the longitudinal seam.

It is to be noted that the longitudinal seam 70 as shown in FIG. 2 is constructed from a ribbon of outer web 16 of a given width and a ribbon of inner web 18 (and its coating 20) of equal width which are joined together as they are drawn toward the poucher machine 50, as shown in FIG. 4. To construct a pouch where only the outer web 16 is present along the longitudinal seam 70, the pouch is constructed from a joinder of a ribbon of outer web 16 having a greater width than that of the inner web 18 (and its coating 20). Accordingly and in reference to FIG. 4, as such webs 16 and 18 enter the poucher machine 50, the narrower ribbon of inner web 18 is preferably centered and joined with the wider ribbon of the outer web 16, such that the longitudinal edges of the wider ribbon of outer web 16 are left uncovered and are available for formation of the longitudinal seam 70 without the presence of the inner web 18 and its coating 20. The technique provides a simpler and more robust seam structure along the longitudinal seam 70. It is also envisioned that the outer and inner webs 16 and 18 may be provided with equal widths but that the coating 20 is centered along one of the webs and is provided a lesser width so that the longitudinal seam 70 is formed without the presence of the coating 20 and consists essentially of the inner web and the outer web.

Single layer pouch wrappers having a coating on an outside or inside surface when forming the pouch, such as the pouch wrapper disclosed in U.S. Provisional Application Publication No. 60/675,900, filed on Apr. 28, 2006 and published as U.S. Patent Application Publication No. 2007/0012328, the entire content of which is incorporated herein by reference, can be difficult to form because the coating contacts surfaces of pouch forming machines. Thus, components of the coating often stick to the pouch forming machines causing build-up on the surfaces thereof. The pouch wrapper described herein includes a coating on an inner web and/or outer web that lies between the outer web and the inner web when the pouch is formed. Since the coating is between two web layers, the coating does not contact surfaces of pouch forming machines thereby decreasing and/or preventing build-up of coating components on the surfaces of the machines.

Preferably, the coating 20 includes at least one flavorant and/or other additives, such that the coating 20 rapidly releases at least one flavorant and/or other additives when inserted into an oral cavity. Additionally, the coating 20, the outer web 16 and/or the inner web 18 can include humectants that soften the pouch wrapper 12 during use, such that the pouch wrapper 12 is comfortable in the mouth of a user.

Preferably, the coating 20 comprises at least one polymer, a negligible amount of water and at least one flavorant. In an embodiment, the coating 20 can also include additives, such as sweeteners and/or humectants. In other embodiments, the additives described below can also be included in the coating 20. The flavor can be a flavor concentrate mixed with other ingredients selected from the group consisting of sucrose, propylene glycol, sucralose, starch, glycerin, sodium alginate, gum arabic, gum acacia, beta cyclodextriate, microcrystalline cellulose, monodiglyceride, water and combinations thereof.

Preferably, the coating 20 is water-soluble, such that the coating 20 rapidly dissolves and releases one or more flavors when placed in a user's mouth. In an embodiment, the coating 20 may include a cross-linked polymer. The amount of cross-linking can be varied to alter the rate of dissolution of the coating 20. Preferably, the viscosity of the solution which forms the coating is about 600 cps to about 6,000 cps, but may be higher or lower depending on the coating formulation and/or method of application to the inner and/or outer paper layer.

The coating 20 can include synthetic and/or natural polymers. Exemplary polymers include, without limitation, hydrocolloids, polysaccharides, food proteins, and the like. The polymers can be cross-linkable, non-cross-linkable or combinations thereof.

Suitable non-chemically-cross-linkable polymers include, without limitation, starch and starch derivatives, such as modified starch, dextrin, gums, such as gum arabic, guar gum, xanthan gum, locust bean gum, curdlan gum, gellan gum, fenugreek derivative gums, pullulan, chitosan, chitin, cellulose and cellulose derivatives, synthetic polymers, such as polyvinyl alcohol, polylactide, polyethylene glycol, polyvinylpyrrolidone, or polyvinylacetate, proteins, such as gelatin, zein, soy protein, rice protein, and whey protein, and soluble or insoluble vegetable fiber.

Suitable chemically cross-linkable polymers include, without limitation, alginate, pectin, carrageenan, and modified polysaccharides with cross-linkable functional groups.

When a cross-linking agent is used, the cross-linking agent is a polyvalent metal salt, more particularly, a monovalent metal ion salt or bivalent metal ion salt. While, both monovalent and bivalent metal ion salts may be used, a bivalent metal ion salt is particularly suitable for crosslinking certain polysaccharides, such as pectins. Suitable cross-linking agents include, without limitation, calcium lactate, calcium chloride, calcium lactobionate, tricalcium phosphate, calcium glycerophosphate, calcium hexametaphosphate, calcium acetate, calcium carbonate, calcium bicarbonate, calcium citrate, calcium gluconate, sodium chloride, sodium lactate, sodium acetate, sodium carbonate, sodium bicarbonate, sodium citrate, sodium gluconate, potassium chloride, potassium lactate, potassium acetate, potassium carbonate, potassium bicarbonate, potassium citrate, potassium gluconate and combinations of these.

The coating 20 can include encapsulated flavorants in the form of beads and/or microcapsules embedded therein. The beads and/or microcapsules can contain controlled release flavorants and/or other additives, such as sweeteners, humectants and the like.

The coating 20 preferably dissolves in about 0.1 second to about 5 minutes (e.g., about 1 second to about 4 minutes, about 2 seconds to about 3 minutes, about 3 seconds to about 2 minutes or about 4 seconds to about 1 minute) after introduction into the oral cavity.

Preferably, the coating 20 is applied to a first side 24 of the inner web 18 as a solution, suspension and/or emulsion. For example, the desired ingredients of the coating 20 can be mixed to form a solution, which is then transferred to the first side 24 of the inner web 18 which preferably has a heat sealable adhesive layer on the opposite side. In an embodiment, the outer web 16 includes an adhesive layer on a surface facing the inner web 18. Suitable methods for applying the coating 20 to the first side 24 of the inner web 18 include spray, slot die and/or gravure application methods.

In a preferred embodiment, the coating 20 is added in an amount of about 1 $g/m^2$ to about 50 $g/m^2$ on a dry weight basis to the inner web and the coating, when dried, can have a moisture content of about 5% to about 8%.

In a preferred embodiment, the inner web 18 reduces the tendency of the inner botanical filling material 22 to discolor (stain) the outer web 16. The inner web 18 reduces staining of the outer web 16 by reducing the opportunity for moisture from the inner botanical filling material 22 or its additives to reach the outer web 16 prior to use. The inner web 18 and coating 20 also allow the moisture content and other constituents of the inner botanical filling material 22 to be maintained in its original (fresh) condition until use. Also, by providing the coating on a side of the inner web facing the outer web, contact of automated machinery parts with the flavor coating can be minimized during high speed pouch forming and filling operations thereby avoiding build-up of the coating components on machinery parts.

In a preferred embodiment, the inner botanical filling material 22 includes at least one botanical material. As used herein, the term "botanical material" or "botanical materials" describes vegetable and/or plant fibers, particles, granules, encapsulated plant material, colloidal encapsulated plant material and powders that can be obtained from the roots, leaves, stems, flowers, pollen, fruits, nuts, or any other plant material. The botanical material can be included in the form of powders, granules, fibers and combinations thereof. Examples of suitable botanical materials include, without limitation, tobacco, tea, coffee, vegetables, such as beet fibers, spices, herbs, and the like.

In a preferred embodiment, the inner botanical filling material 22 includes a tobacco component. Exemplary tobacco materials can be made of cut or ground tobacco and can include flavorants, additives and/or humectants. Examples of suitable types of tobacco materials that may be used include, but are not limited to, flue-cured tobacco, Burley tobacco, Maryland tobacco, Oriental tobacco, rare tobacco, specialty tobacco, reconstituted tobacco, blends thereof and the like. In an embodiment, the tobacco material is pasteurized. In the alternative, the tobacco may be fermented.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, tobacco beads, blends thereof, and the like. Genetically modified tobacco may also be used.

Humectants can also be added to the tobacco material, coating 20, inner web 18 and/or outer web 16 of the pouch wrapper 12 to help maintain the moisture levels in the oral pouch product 10. Examples of humectants that can be used include, without limitation, glycerol and propylene glycol. It is noted that the humectants can also be provided for a preservative effect, as the water activity of the oral pouch product 10 can be decreased with inclusion of a humectant, thus reducing opportunity for growth of micro-organisms. Additionally, humectants can be used to provide a higher moisture feel to a drier tobacco component.

The inner botanical filling material 22 and/or the coating 20 on the inner and/or outer web 16, 18 can include at least one flavorant. Suitable flavorants include any flavorants commonly used in foods, confections, smokeless tobacco products, tobacco articles, and/or other oral products. Exemplary flavorants include, but are not limited to, berry flavors such as pomegranate, acai, raspberry, blueberry, strawberry, boysenberry, and/or cranberry. Other suitable flavorants include, without limitation, any natural or synthetic flavor or aroma, such as menthol, peppermint, spearmint, wintergreen, bourbon, scotch, whiskey, cognac, hydrangea, lavender, chocolate, licorice, citrus and other fruit flavors, such as apple, peach, pear, cherry, plum, orange, lime, grape, and grapefruit, gamma octalactone, vanillin, ethyl vanillin, breath freshener flavors, butter, rum, coconut, almond, pecan, walnut, hazelnut, French vanilla, macadamia, sugar cane, maple, cassis, caramel, banana, malt, espresso, kahlua, white chocolate, spice flavors such as cinnamon, clove, cilantro, basil, oregano, garlic, mustard, nutmeg, rosemary, thyme, tarragon, dill, sage, anise, and fennel, methyl salicylate, linalool, jasmine, coffee, olive oil, sesame oil, sunflower oil, bergamot oil, geranium oil, peanut oil, lemon oil, ginger oil, balsamic vinegar, rice wine vinegar and red wine vinegar.

Preferably, the flavorants can be applied to the inner botanical filling material 22 by spraying, coating, immersing, embossing, and/or dispersing the flavorants into or onto the inner botanical filling material. In an embodiment, the flavorants are added in the form of spray dried flavorants, essential oils, encapsulated flavorants, coacervated flavorants, colloidal encapsulated flavorants, suspensions, and/or solutions.

When the flavorants are encapsulated, the flavorants can also be provided by controlled release mechanisms such as pH change, heat activation, or mechanical activation through manipulating or sucking. In addition, flavorant capsules can have encapsulating coatings of various thicknesses so that the flavorants are released at varying rates to provide continuous or different flavor throughout use of the oral pouch product.

In a preferred embodiment, inner botanical filling material 22 and/or the coating 20 on the inner web 18 can include additives, such as vitamins, minerals, nutraceuticals, energizing agents, soothing agents, sweeteners, coloring agents, amino acids, antioxidants, preservatives and/or combinations thereof.

In an embodiment, suitable sweeteners include, without limitation, monosaccharides, disaccharides, and polysaccharides, xylose, ribose, sucrose, maltose, mannitol, sorbitol, xylitol, fructose, glucose, mannose, sucralose, and combinations thereof.

Soothing agents can be included to provide a soothing sensation to the throat and oral cavity. Suitable soothing agents include, without limitation, chamomile, lavender, jasmine, and the like.

Suitable energizing ingredients include, without limitation, caffeine, taurine, and guarana.

Suitable vitamins include, without limitation, vitamin A (retinol), vitamin D (cholecalciferol), vitamin E group, vitamin K group (phylloquinones and menaquinones), thiamine (vitamin $B_1$), riboflavin (vitamin $B_2$), niacin, niacinamide, pyridoxine (vitamin $B_6$ group), folic acid, choline, inositol, vitamin $B_{12}$ (cobalamins), PABA (para-aminobezoic acid), biotin, vitamin C (ascorbic acid), and mixtures thereof. The amount of vitamins incorporated into an oral pouch product can be varied according to the type of vitamin and the intended user. For example, the amount of vitamins may be formulated to include an amount less than or equal to the recommendations of the United States Department of Agriculture Recommended Daily Allowances.

As used herein, the term "nutraceuticals" refers to any ingredient in foods that has a beneficial effect on human health. Nutraceuticals include particular compounds and/or compositions isolated from natural food sources and genetically modified food sources. For example, nutraceuticals include various phytonutrients derived from natural plants and genetically engineered plants.

Suitable minerals include, without limitation, calcium, magnesium, phosphorus, iron, zinc, iodine, selenium, potassium, copper, manganese, molybdenum, chromium, and mixtures thereof. The amount of minerals incorporated into the oral pouch product can be varied according to the type of vitamin and the intended user. For example, the amount of minerals may be formulated to include an amount less than or equal to the recommendations of the United States Department of Agriculture Recommended Daily Allowances.

Suitable amino acids include, without limitation, the eight essential amino acids that cannot be biosynthetically produced in humans, including valine, leucine, isoleucine, lysine, threonine, tryptophan, methionine, and phenylalanine. Examples of suitable amino acids include the non-essential amino acids including alanine, arginine, asparagine, aspartic acid, cysteine, glutamic acid, glutamine, glycine, histidine, proline, serine, and tyrosine.

In another embodiment, the oral pouch product can include various active agents having antioxidant properties that can delay the ageing process. For example, the active ingredients that can be extracted from *Ginkgo biloba* include flavonoid glycosides ("ginkgoflavonoids"), such as (iso) quercitin, kaempferol, kaempferol-3-rhamnosides, isorhamnetin, luteolin, luteolin glycosides, sitosterol glycosides, and hexacyclic terpene lactones, referred to as "ginkgolides" or "bilobalides." The active ingredients that can be extracted from *Camellia sinensis*, such as green tea, include various "tea tannins," such as epicatechol, epigallocatechol, epigallocatechol gallate, epigallocatechol gallate, theaflavin, theaflavin monogallate A or B, and theaflavin digallate. The active ingredients that can be extracted from *Vaccinium myrtillus*, such as blueberry, include at least 15 different anthocyanosides, such as delphinidin, anthocyanosides, myrtin, epimyrtin, phenolic acids, glycosides, quercitrin, isoquercitrin, and hyperoside. The active ingredients that can be extracted from *Vinis vitifera*, such as grapes, include polyphenols, catechols, quercitrins, and resveratrols. The active ingredients that can be extracted from *Olea europensis*, such as the leaves of olive trees, include oleuropein. Many active ingredients identified from these and other plant sources associated with the neutralization of free radicals and useful for delaying the ageing process are contemplated. The active ingredients of *Trifolium pratense*, such as purple clovers (i.e., common purple trefoils), include isoflavones or isoflavone glucosides, daidzein, genestein, formononentin, biochanin A, ononin, and sissostrin. The health-promoting properties of compounds derived from *Panax*, a genus that includes Ginseng, are well-established. These and other botanicals, botanical extracts, and bioactive compounds are contemplated.

Such botanical extracts can be prepared by various methods known in the art, including maceration, remaceration, digestion, agitation maceration, vortex extraction, ultrasonic extraction, countercurrent extraction, percolation, repercolation, evacolation, diacolation, and solid/liquid extraction under continuous reflux. Other antioxidants known in the art are also contemplated.

Suitable preservatives for inclusion in the oral pouch product 10 include, without limitation, methyl paraben, propyl paraben, sodium propionate, potassium sorbate, sodium benzoate and the like.

In a preferred embodiment, the inner web 18 and the outer web 16 comprise paper suitable for oral pouch products commonly referred to as "snus" or snuff. For example, the web can be formed of a cellulose fiber material, such as tea bag material or materials typically used to form snus pouches. Preferably, the material used to form the web has a neutral or pleasant taste or aroma. Also preferably, the material used to form the web is safe for use in the oral cavity. Preferably, the material used to form the web is selected to have desired properties of stain resistance, water permeability and/or porosity, and/or water insolubility.

Additionally, the materials used to form the web 16, 18 can be provided with predetermined levels for basis weight and/or wet strength in order to reduce occurrence of breakage of the pouch wrapper 12 during manufacturing operations, storage and use. For example, webs 16, 18 can be provided with a basis weight of about 5 to about 25 g/m$^2$, such as 5-10, 10-15, 15-20, or 20-25 grams/meters$^2$ (g/m$^2$) depending upon the final usage requirements, and/or a wet tensile cross-direction (CD) strength of about 15 to about 75 N/m, such as 15-30, 30-45, 45-60, or 60-75 Newtons/meter (N/m) depending upon the final usage requirements. One exemplary material is a tea bag material with a basis weight of about 16.5 g/m$^2$ with a wet tensile CD strength of 68 N/m.

It is also noted that the thickness of the webs 16, 18 can be varied to achieve desired levels of solubility through the pouch wrapper 12. For example. the paper can be about 0.1 mm to about 0.125 mm thick or about 0.07 mm to about 0.08 mm thick. Preferably, the paper has a permeability of at least about 80,000 Coresta units.

In a preferred embodiment, the oral pouch product 10 is sized and configured to fit comfortably in a user's mouth, preferably between the cheek and gum. For example, the length of the oral pouch product 10 can be up to about 5 cm, the width can be up to about 5 cm, and the height can be up to about 3 cm. In various embodiments, the oral pouch product 10 can have a length from about 1 cm to about 5 cm, from about 1 cm to about 4 cm, from about 1 cm to about 3 cm, or from about 1 cm to about 2 cm. The oral pouch product 10 can have a width from about 1 cm to about 5 cm, from about 1 cm to about 4 cm, from about 1 cm to about 3 cm, or from about 1 cm to about 2 cm. The oral pouch product 10 can have a height from about 10 mm to about 3 cm, from about 10 mm to about 2.5 cm, from about 10 mm to about 2 cm, from about 10 mm to about 1.5 cm, or from about 10 mm to about 1 cm.

The oral pouch product 10 may be formed in many shapes including, without limitation, spheres, rectangles, oblong shapes, crescent shapes, ovals, and cubes. In a preferred embodiment, the pre-portioned product is rectangular and weighs about 1.0 g to about 3.5 g, more particularly about 2.5 g to 3.0 g (e.g., about 2.6 g to about 2.9 g or about 2.7 g to about 2.8 g).

The coating 20 is preferably applied to the inner web 18, but could instead be applied to the outer web 16 on the side adjacent to the inner web 18 or on facing surfaces of both the inner web 18 and the outer web 16.

In addition, the coating 20 of the inner web 18, outer web 16 or both provides flavorants and promotes salivation.

Products constructed in accordance with the embodiments described herein provide a soft mouth feel including soft edges and a pliable body. The double layer structure also enhances wet strength of the pouch product and enhances capacity to withstand handling during packaging and use.

In this specification, the word "about" is often used in connection with numerical values to indicate that mathematical precision of such values is not intended. Accordingly, it is intended that where "about" is used with a numerical value, a tolerance of 10% is contemplated for that numerical value.

While the foregoing describes in detail an oral pouch product with reference to a specific embodiment thereof, it will be apparent to one skilled in the art that various changes and modifications equivalents to the oral tobacco product and process steps may be employed, which do not materially depart from the spirit and scope of the invention.

What is claimed is:

1. An oral pouch product, comprising:

a pouch wrapper comprising:

an inner web;

an outer web;

a coating on an outer side of the inner web; and at least one seam including portions of the inner web, the outer web and the coating; and an inner botanical filling material contained within the pouch wrapper, wherein the inner web is surrounded by the outer web, the entirety of the coating is disposed between the inner web and the outer web, and the coating is coextensive with the inner web and the outer web.

2. The oral pouch product of claim 1, wherein the inner web includes an adhesive layer on a side thereof facing the inner botanical filling material and/or the outer web includes an adhesive layer on a side thereof facing the inner web.

3. The oral pouch product of claim 1, wherein the at least one seam of the pouch wrapper includes a longitudinal seam and two transverse seams.

4. The oral pouch product of claim 3, wherein the longitudinal seam includes edges of the outer web.

5. The oral pouch product of claim 1, wherein the coating comprises at least one polymer and at least one flavorant.

6. The oral pouch product of claim 1, wherein the coating is present in an amount of about 1 $g/m^2$ to about 50 $g/m^2$ on the inner web and/or the outer web and wherein the coating has a moisture content of about 5% to about 8%.

7. The oral pouch product of claim 1, wherein the inner botanical filling material is selected from the group consisting of tobacco, tea, coffee, vegetable fibers, herbs, spices and combinations thereof.

8. The oral pouch product of claim 5, wherein the at least one flavorant is a flavor concentrate and/or an encapsulated flavorant.

9. The oral pouch product of claim 1, wherein the outer web is unflavored paper.

10. The oral pouch product of claim 5, wherein the coating further includes additives selected from the group consisting of vitamins, minerals, nutraceuticals, energizing agents, soothing agents, sweeteners, coloring agents, amino acids, antioxidants, and combinations thereof.

11. The oral pouch product of claim 1, wherein the inner botanical filling material comprises smokeless tobacco.

12. The oral pouch product of claim 1, wherein the outer web is white in color.

13. The oral pouch product of claim 1, wherein the outer web includes a heat sealant on a side of the outer web facing the inner web and the inner web includes the coating on a side of the inner web facing the outer web.

14. The oral pouch product of claim 1, wherein the coating dissolves in saliva in about 0.1 seconds to about 5 minutes.

* * * * *